US008010030B2

(12) United States Patent
Senda et al.

(10) Patent No.: US 8,010,030 B2
(45) Date of Patent: Aug. 30, 2011

(54) IMAGE FORMING APPARATUS ROLLER CONFIGURATION

(75) Inventors: Seiichi Senda, Aichi-ken (JP); Makoto Souda, Aichi-ken (JP)

(73) Assignee: Brother Kogyo Kabushiki Kaisha, Aichi-ken (JP)

( * ) Notice: Subject to any disclaimer, the term of this patent is extended or adjusted under 35 U.S.C. 154(b) by 433 days.

(21) Appl. No.: 12/238,828

(22) Filed: Sep. 26, 2008

(65) Prior Publication Data

US 2009/0087235 A1 Apr. 2, 2009

(30) Foreign Application Priority Data

Sep. 27, 2007 (JP) ..... 2007-252263

(51) Int. Cl.
*G03G 21/16* (2006.01)

(52) U.S. Cl. ..... 399/329

(58) Field of Classification Search ..... 399/329, 399/328

See application file for complete search history.

(56) References Cited

U.S. PATENT DOCUMENTS

| | | | |
|---|---|---|---|
| 2005/0008412 | A1 | 1/2005 | Aruga |
| 2005/0163540 | A1 | 7/2005 | Umezawa |
| 2006/0008294 | A1 | 1/2006 | Ito |

FOREIGN PATENT DOCUMENTS

| | | | |
|---|---|---|---|
| JP | 9114281 | | 5/1997 |
| JP | 09329981 | A * | 12/1997 |
| JP | 2001-22202 | | 1/2001 |
| JP | 2001-125422 | | 5/2001 |
| JP | 2004198556 | | 7/2004 |
| JP | 200510611 | | 1/2005 |
| JP | 2005166299 | | 6/2005 |
| JP | 2007-199747 | | 8/2007 |

OTHER PUBLICATIONS

Computer_translation-JP09-329981A, Dec. 1997.*
JP Office Action, Appln. No. 2007-252263, mail date Aug. 11, 2009.

* cited by examiner

*Primary Examiner* — Quana M Grainger
(74) *Attorney, Agent, or Firm* — Banner & Witcoff, Ltd

(57) ABSTRACT

An image forming apparatus, such as a laser printer, may use high levels of heat to form images, and some elements may expand and contract with changing temperatures. An apparatus may include a heat roller disposed against a pressure roller, with an endless belt member enclosing the pressure roller. The belt member may also have different frictional characteristics on an inside and outside of the roller, such that when peripheral speeds change due to expansion of the pressure roller, the belt member may be configured to slip against the pressure roller, and maintain a frictional relationship with the heat roller (or a printing medium, such as paper, that is pinched between the rollers). Additionally, the rotational speed of an axis of the pressure roller may be adjusted to compensate for the thermal expansion.

22 Claims, 5 Drawing Sheets

IMAGE FORMING APPARATUS ROLLER CONFIGURATION

CROSS REFERENCE TO RELATED APPLICATION

This application claims priority from Japanese Patent Application No. 2007-252263, filed on Sep. 27, 2007, the entire subject matter of which is incorporated herein by reference.

FIELD

Aspects described herein relate to a fixing unit having a pressure roller and a heat roller, and an image forming apparatus including such a fixing unit.

BACKGROUND

A known image forming apparatus, e.g., a laser printer, includes a fixing unit that is configured to fix a developer image transferred from a photosensitive member onto a recording sheet by heat. The fixing unit includes a heat roller that is subjected to heat from a heat source and receives power, and a pressure roller that is pressed against the heat roller.

To enhance the speed of image formation processing of the image forming apparatus, the fixing unit is used to enhance the speed of heat fixing. However, it is difficult to increase a surface temperature of the heat roller further in view of, for example, the melting point of a fluorine resin coated on the surface of the pressure roller. Thus, a nip width between the pressure roller and the heat roller is increased to extend a contact area between a recording sheet and the heat roller, to cope with high-speed heat fixing.

However, when the pressure roller is pressed against the heat roller, a part of the pressure roller that the heat roller contacts is deformed, e.g. dented, because the pressure roller is covered with an elastic layer. Such deformation of the pressure roller may increase a force of the pressure roller hindering sheet conveyance more than a force of the heat roller facilitating sheet conveyance, which may lead to a slippage between the heat roller and a recording sheet.

To solve this problem, the pressure roller may be forced to rotate while the heat roller is rotated. In this case, the outside diameter of the pressure roller changes because a surface (elastic layer) of the pressure roller expands with heat, and thus a peripheral speed of the pressure roller changes, which causes a difference in peripheral speed between the pressure roller and the heat roller, and results in a slippage between the pressure roller and the heat roller. Accordingly, a difference in sheet conveyance speed between both sides (a side facing the heat roller and a side facing the pressure roller) of a recording sheet occurs, which also causes a slippage between the heat roller and a sheet.

When the heat roller and the sheet slip, a trace of the heat roller may be left on the sheet, and a developer image on the sheet may be scraped against the heat roller, which may impair image quality.

SUMMARY

Aspects described herein provide a fixing unit configured to enhance image quality and an image forming apparatus including such a fixing unit.

BRIEF DESCRIPTION OF THE DRAWINGS

Illustrative aspects will be described in detail with reference to the following figures in which like elements are labeled with like numbers and in which.

DETAILED DESCRIPTION

Figure 1:
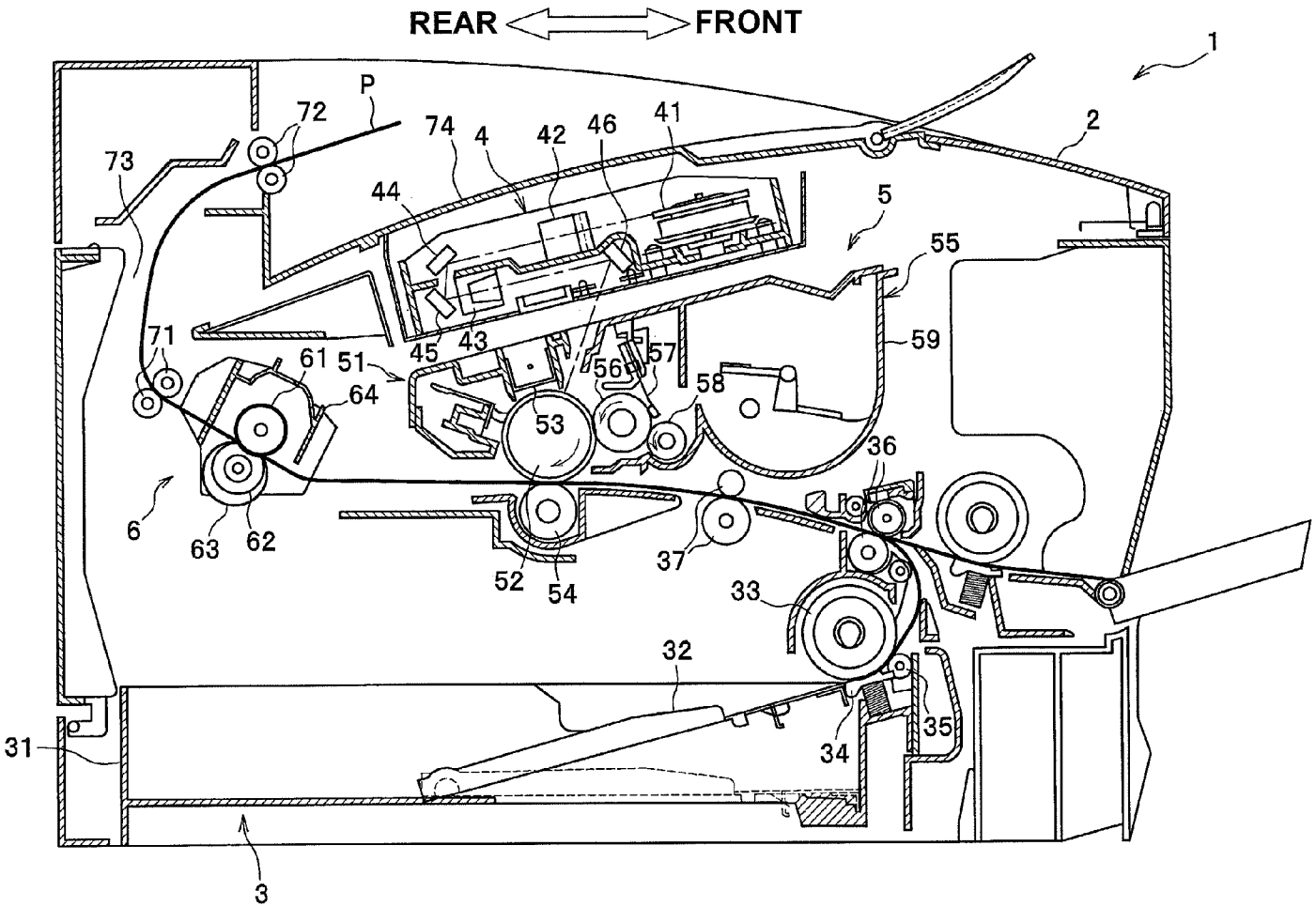
FIG. 1 is a side sectional view of an internal structure of a laser printer as an illustrative example of an image forming apparatus using features described herein.

An illustrative embodiment will be described in detail with reference to the accompanying drawings. An image forming apparatus according to aspects described herein applies to a laser printer 1 as shown in FIG. 1. It will be appreciated that these aspects also apply to other types of image forming apparatuses, such as a copier and a multifunction apparatus as well.

For ease of discussion, in the following description, the top or upper side, the bottom or lower side, the left or left side, the right or right side, the front or front side, and the rear or rear side are used to define the various parts when the laser printer 1 is disposed in an orientation in which it is intended to be used. In FIG. 1, the right side is referred to as the front or front side, the left side is referred to as the rear or the rear side, the up side is referred to as the top or upper side, and the down side is referred to as the bottom or lower side.

As shown in FIG. 1, the laser printer 1 may include, in a main body 2, a sheet supply section 3, a light exposure unit 4, a process cartridge 5, and a fixing unit 6. The sheet supply section 3 is configured to supply a recording sheet, e.g., a sheet P. The process cartridge 5 is configured to transfer an image of developer, e.g., toner, onto the sheet P. The fixing unit 6 may be configured to fix the toner image onto the sheet by heat.

The sheet supply section 3 may include a sheet supply tray 31, a sheet pressing plate 32, a pickup roller 33, a separation pad 34, dust removing rollers 35, 36, and registration rollers 37. The sheet supply tray 31 may be disposed in a lower portion of the main body 2 and configured to be attached to and removed from the main body 2. The pickup roller 33 and the separation roller 34 are disposed in a front upper portion of the sheet supply tray 31. The dust removing rollers 35, 36 are disposed at a downstream side from the pickup roller 33 in a direction where the sheet P is conveyed (hereinafter referred to as the sheet conveyance direction). The registration rollers 37 are disposed at the downstream side from the dust removing rollers 35, 36 in the sheet conveyance direction.

In the sheet supply section 3, a sheet P in a stack of sheets in the sheet supply tray 31 is moved to the pickup roller 33 by the sheet pressing plate 32, singly conveyed by the pickup roller 33 and the separation pad 34, passed through the dust removing rollers 35, 36 and the registration rollers 37, and conveyed to the process cartridge 5.

The light exposure unit 4 may be disposed in an upper portion of the main body 2. The exposure unit 4 may include a light emitting portion (not shown), a polygon mirror 41 configured to be driven to rotate, lenses 42, 43, and reflecting mirrors 44, 45, 46. In the exposure unit 4, as shown in a broken line, a laser beam emitted from the light emitting portion, based on image data, may be deflected by the polygon mirror 41, pass through the lens 42, be folded by the reflecting mirrors 44, 45, pass through the lens 43, and be bent downward by the reflecting mirror 46, to be directed to a surface of the photosensitive drum 52 in the process cartridge 5 at high speed scanning.

The process cartridge 5 may be disposed under the exposure unit 4, and configured to be attached to and removed from the main body 2. The process cartridge 5 includes a cartridge frame 51 that is hollow and serves as an outer frame. The process cartridge 5 further includes a photosensitive member, e.g., a photosensitive drum 52, a scorotron charger 53, a transfer member, e.g., a transfer roller 54, and a developer cartridge 55 in the cartridge frame 51.

The developer cartridge 55 may be mounted in the cartridge frame 51 in a detachable manner. The developer cartridge 55 includes a developing roller 56, a layer-thickness regulating blade 57, a supply roller 58, and a toner chamber 59. Developer, e.g., toner, stored in the toner chamber 59, is supplied to the developing roller 56 along with the rotation of the supply roller 58. At this time, toner is electrically charged between the supply roller 58 and the developing roller 56 by friction. The toner supplied to the developing roller 56 goes in between the layer-thickness regulating blade 57 and the developing roller 56 along with the rotation of the developing roller 56, and is carried on the developing roller 56 as a thin layer having a constant thickness.

The photosensitive drum 52 may be rotatably supported by the cartridge frame 51. The photosensitive drum 52 includes a drum body that is grounded and an outer surface thereof that is formed of a photosensitive layer.

The transfer roller 54 may be disposed below the photosensitive drum 52, contacting the photosensitive drum 52 from below, and rotatably supported by the cartridge frame 51. During image transfer, a bias is applied to the transfer roller 54.

In the process cartridge 5, the surface of the photosensitive drum 52 may be uniformly and positively charged by the scorotron charger 53, and exposed to a laser beam emitted from the exposure unit 4 by high-speed scanning. An electric potential in the exposed area of the surface of the photosensitive drum 52 becomes low, and an electrostatic latent image is formed based on the image data.

When the developing roller 56 is rotated, toner carried on the developing roller 56 is supplied to the electrostatic latent image formed on the surface of the photosensitive drum 52. As toner is selectively carried on the surface of the photosensitive drum 52, the latent image on the photosensitive drum 52 becomes visible, and a toner image is formed by reversal.

The photosensitive drum 52 and the transfer roller 54 are rotated to convey the sheet P therebetween. While the sheet P is conveyed between the photosensitive drum 52 and the transfer roller 54, the toner image carried on the photosensitive drum 52 is transferred onto the sheet P.

The fixing unit 6 may be disposed at the rear of the process cartridge 5 or at a downstream side of the process cartridge 5 in the sheet conveyance direction. The fixing unit 6 may include a heat roller 61, a pressure roller 62 configured to be pressed against the heat roller 61, a belt member 63 disposed around the pressure roller 62, and a frame member 64. Ejection rollers 71, 72, and a sheet ejection path 73 are provided at the downstream side from the fixing unit 6 in the sheet conveyance direction, so as to eject the sheet P conveyed from the fixing unit 6 out of the main body 2.

In the fixing unit 6, the toner image transferred onto the sheet P is fixed by heat while the sheet P passes between the heat roller 61 and the belt member 63 disposed around the pressure roller 62. After passing through the fixing unit 6, the sheet P is conveyed to the sheet ejection path 73 by the ejection rollers 71, and ejected to a sheet ejection tray 74 by the ejection rollers 72.

Figure 2:
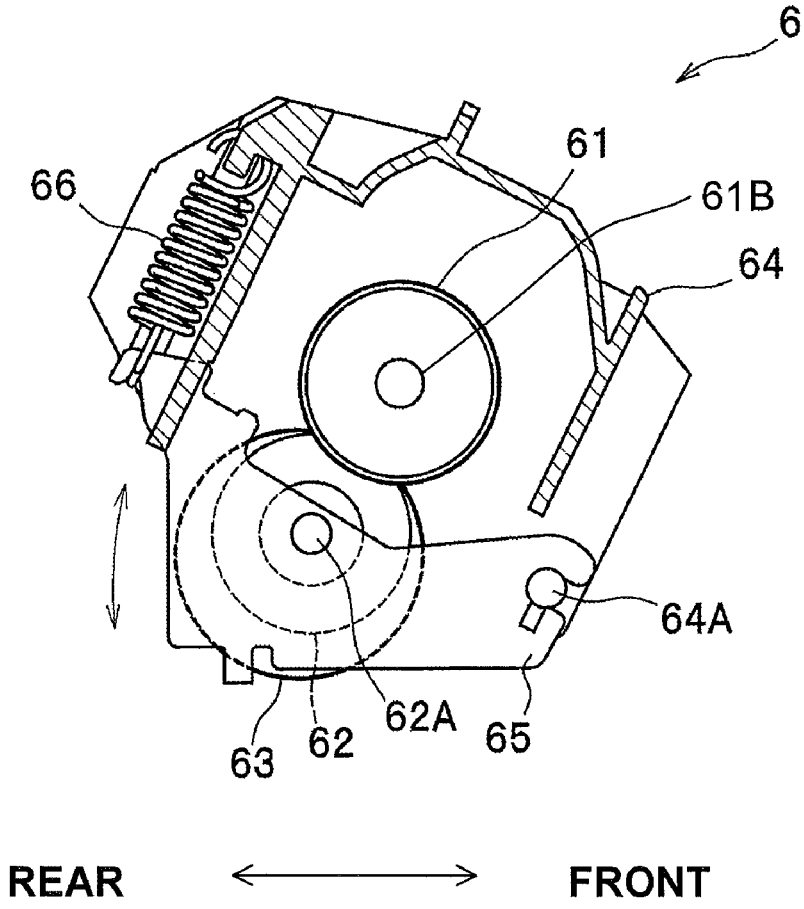
FIG. 2 is a side view of a fixing unit of FIG. 1.
Figure 3:
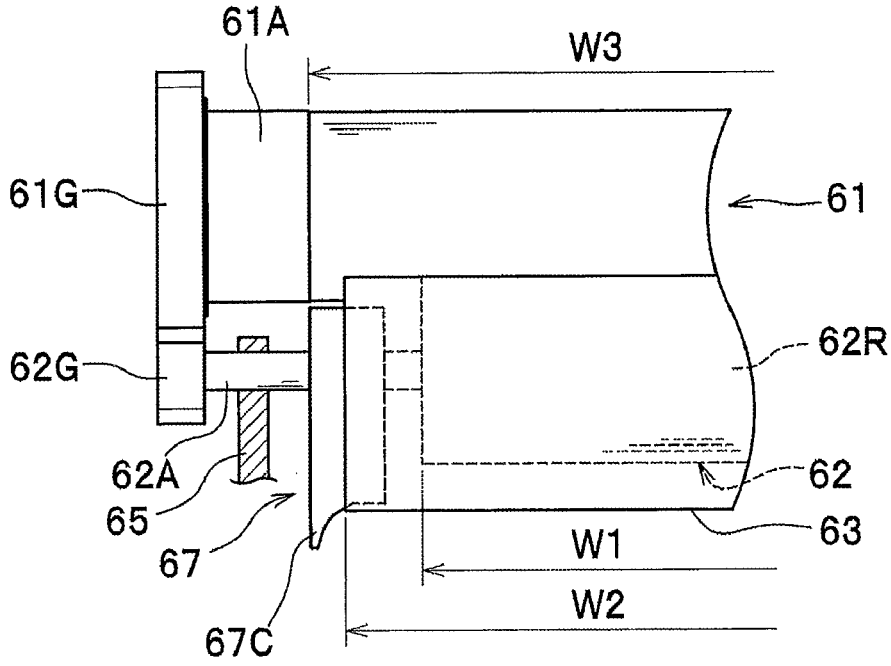
FIG. 3 schematically shows a heat roller, a pressure roller, a belt member, and a regulating member.

As shown in FIGS. 2 and 3, the fixing unit 6 may further include arm members 65 (only one shown) and extension springs 66 (only one shown), and belt supporting members 67 (only one shown). The pressure roller 62 is supported by the arm members 65 and the extension springs 66.

The heat roller 61 may be formed in a generally cylindrical shape, and may have a heat source 61B, such as a halogen heater, therein. The heat roller 61 may be configured such that a surface thereof becomes heated to a temperature for fixing toner by the heat source 61B. Both ends 61A of the heat roller 61 protruding axially therefrom may be supported by the frame member 64, so that the heat roller 61 is rotatable. A transmission gear 61G may be fixed to one end 61A, and rotated along with the heat roller 61. Power from a drive source (not shown) disposed in the main body 2 may be supplied via gears (not shown) to the transmission gear 61G, which causes the heat roller 61 to rotate.

The pressure roller 62 may include a cylindrically-shaped roller portion 62R made of an elastic layer, e.g., a silicone rubber, and a rotation shaft 62A extending through the roller portion 62R and protruding outward from both ends of the roller portion 62R. The rotation shaft 62A may be rotatably supported by the arm members 65. A transmission gear 62G may be fixed to an end of the rotation shaft 62A and configured to rotate along with the pressure roller 62. The transmission gear 62G is engaged with the transmission gear 61G. Thus, power from the heat roller 61 may be transmitted to the pressure roller 62 via the transmission gears 61G, 62G, and the pressure roller 62 may be forced to rotate along with the heat roller 61.

The arm members 65 may be disposed on both ends of the rotation shaft 62A of the pressure roller 62. A front side (right side in FIG. 2) of each arm member 65 may rotatably support a support shaft 64A disposed in the frame member 64, and an upper rear side of each arm member 65 may be attached to one end of the extension spring 66. The other end of the extension spring 66 may be attached to the frame member 64. Thus, the pressure roller 62 rotatably supported by the arm members 65 is capable of moving in a direction of an arrow of FIG. 2. As each arm member 65 is urged toward the heat roller 61 under a force applied from the extension spring 66, the pressure roller 62 is also urged or pressed toward the heat roller 61.

The belt member 63 may be an endless member (e.g., circular, such as a conveyor belt) having a perimeter greater than a perimeter of the pressure roller 62 (that is, specifically, a maximum perimeter of the pressure roller 62 thermally expanding). In other words, the endless member may loosely enclose the pressure roller to accommodate thermal expansion of the roller 62. The belt member 63 may be disposed around the pressure roller 62 and partially sandwiched between the heat roller 61 and the pressure roller 62. While the toner image is thermally fixed, the sheet P passes between the heat roller 61 and the belt member 63. Thus, during heat fixing, the belt member 63 is sandwiched between the pressure roller 62 and the sheet P and is slidable on the pressure roller 62. The coefficient of friction between the belt member 63 and the pressure roller 62 is smaller than that between the belt member 63 and the sheet P. The belt member 63 is pressed against the heat roller 61 because the pressure roller 62 is pressed against the heat roller 61.

The belt member 63 may be an endless film formed of a heat-resistant resin such as polyimide (PI) or an endless electroformed film formed of nickel or stainless steel.

Figure 4A:
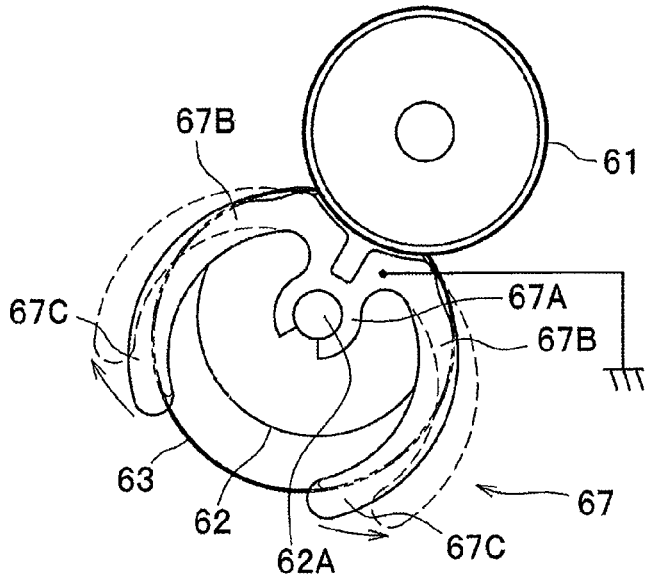
FIG. 4A is a side view of the heat roller, the pressure roller, the belt member, and the regulating member.

When the belt member 63 is formed of a conductive material, e.g., an electroformed film of nickel or stainless steel, the belt member 63 may be electrically grounded. Specifically, as shown in FIG. 4A, the belt member 63 formed of a conductive material is stretched around the belt supporting member 67, which is formed of a conductive resin and is electrically grounded, so that the belt member 63 can be electrically grounded.

A surface of the belt member 63 that contacts the heat roller 61 (or sheet P during heat fixing) may be coated with fluorine resin. Further, fluorine resin can be coated on a surface of the belt member 63 that contacts the pressure roller 62.

As shown in FIG. 3, the belt member 63 has a width W2 extending in an axial direction of the pressure roller 62, which is greater than a width W1 of the roller portion 62R of the pressure roller 62 extending in the axial direction. The width W2 of the belt member 63 is smaller than a width W3 of the heat roller 61 extending in an axial direction of the heat roller 61. Thus, the relationship W1<W2<W3 is established.

Figure 4B:
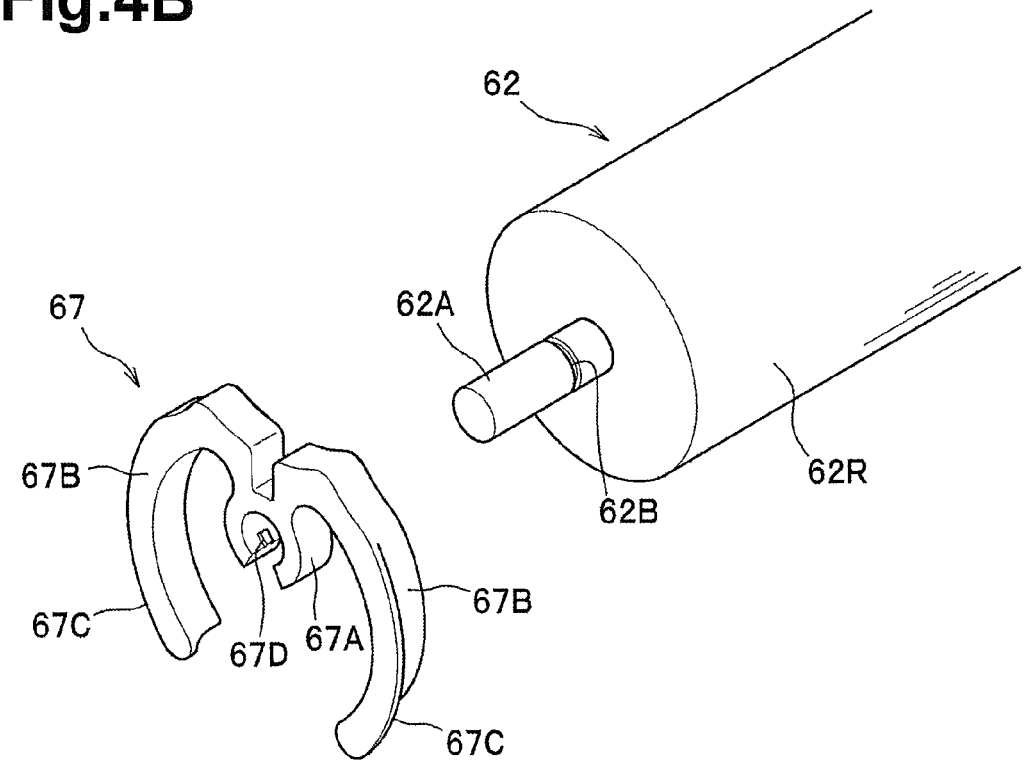
FIG. 4B is a perspective view of the pressure roller and the regulating member.

The belt supporting members 67 may be attached to the rotation shaft 62A of the pressure roller 62 disposed at each end of the roller portion 62R. As shown in FIGS. 4A and 4B, the belt supporting member 67 includes a bearing 67A, belt supporting portions 67B disposed symmetrically with respect to the bearing 67A, and belt regulating portion 67C disposed on the belt supporting portions 67B. The bearing 67A is fitted around the rotation shaft 67A. The belt supporting portions 67B are configured to support the belt member 63 from within.

The bearing 67A may be rotatably fitted around the rotation shaft 62A, so that the belt supporting member 67 will not rotate along with the rotation shaft 62A. As shown in FIG. 4B, when the bearing 67A is attached to the rotation shaft 62A, a protrusion 67D disposed on an inner surface of the bearing 67A is engaged in a groove 62B formed in the rotation shaft 62A. This engagement prevents the belt supporting member 67 from moving in an axial direction of the rotation shaft 62A.

The belt supporting portions 67B may be generally arc-shaped symmetrically from the bearing 67A. A peripheral surface of each belt supporting portion 67B serves as a support surface for supporting the belt member 63.

The peripheral surface of each belt supporting portion 67B may be arcuately recessed so as to match a peripheral surface of the heat roller 61. With this shape, the arcuately recessed portion of the peripheral surface of each belt supporting portion 67B is regulated by the heat roller 61. Thus, the belt supporting member 67 is configured not to rotate even when the belt member 63 is slidingly rotated.

As shown in FIG. 4B, the belt regulating portions 67C are formed on the support surfaces of the corresponding belt supporting portions 67B, and protrude outward further than the belt supporting portions 67B with respect to a radial direction of the bearing 67A. The belt regulating portions 67C are configured to be located outward with respect to the axial direction of the rotation shaft 62A when the belt supporting member 67 is attached to the rotation shaft 62A.

In FIG. 4A, the belt supporting member 67 at its original state is indicated by dashed lines. When the belt supporting member 67 is attached to the rotation shaft 62A, and the belt member 63 is disposed around the pressure roller 62 and the belt supporting member 67, the belt supporting portions 67B are bent toward the bearing 67A as shown in a solid line of FIG. 4A. As the belt supporting portions 67B have the property of returning to their original state, the bent belt supporting portions 67B exert force in arrowed directions of FIG. 4A to apply tension to the belt member 63.

The operation of the fixing unit 6 configured above will be described in the portion appearing below.

As shown in FIG. 3, when the heat roller 61 rotates, its power is transmitted from the transmission gears 61G, 62G to the pressure roller 62, which causes the pressure roller 62 to rotate. The belt member 63 is slidingly rotated along the rotation of the heat roller 61 and the pressure roller 62 in such a manner that the belt member 63 is conveyed between the heat roller 61 and the pressure roller 62. As shown in FIG. 1, while the sheet P having an image thereon is conveyed between the heat roller 61 and the belt member 63, it is sandwiched between the heat roller 61 and the pressure roller 62 via the belt member 63, so that the toner is fixed by heat onto the sheet P. At this time, the peripheral speeds of the heat roller 61 and the pressure roller 62 become substantially equal to the peripheral speed of the belt member 63.

When heat fixing continues, the outside diameter of the pressure roller 62 changes due to thermal expansion, which causes a difference in peripheral speed between the heat roller 61 and the pressure roller 62. At this time, the peripheral speed of the heat roller 61 and the peripheral speed of the belt member 63 are maintained approximated to each other because friction from the heat roller 61 is transmitted to the belt member 63 via the sheet P. However, a difference in peripheral speed between the pressure roller 62 and the belt member 63 occurs. As described above, the coefficient of friction between the belt member 63 and the pressure roller 62 is smaller than that between the belt member 63 and the sheet P. Thus, the inner surface of the belt member 63 and the pressure roller 62 slip, and slippage between the outer surface of the belt member 63 and the sheet P is reduced.

According to the above description, some or all of the following advantages can be obtained.

Even if a difference in peripheral speed between the heat roller 61 and the pressure roller 62 occurs, friction from the heat roller 61 is transmitted to the belt member 63 via the sheet P, so that the inner surface of the belt member 63 and the pressure roller 62 slip. When the pressure roller 62 and the belt member 63 slip, the difference in peripheral speed between the heat roller 61 and the pressure roller 62 is absorbed, so that occurrence of the peripheral speed difference between the heat roller 61 and the belt member 63 is reduced. As the occurrence of the peripheral speed difference between the heat roller 61 and the belt member 63 is reduced, slippage between the heat roller 61 and the sheet P can be reduced, which can offer enhanced image quality.

As the slippage between the heat roller 61 and the sheet P can be reduced, an elastic layer having a lower hardness can be applied to the pressure roller 61 to increase a nip width between the heat roller 61 and the pressure roller 62. This enables enhanced speed of fixing.

The slippage between the pressure roller 62 and the belt member 63 is relatively small in comparison with a structure using a stationary pressure member instead of the pressure roller 62. Thus, adverse effects, such as the wearing away of the belt member 63, abrasion of fluorine resin coated on the surface of the belt member 63, and electrostatic buildup on the belt member 63 due to sliding friction between the pressure roller 62 and the belt member 63 can be reduced.

Power of the heat roller 61 may be transmitted via the transmission gears 61G, 62G to the pressure roller 62, and the pressure roller 62 is forced to rotate. Thus, places on a surface of the pressure roller 62 where the pressure roller 62 is pressed by the heat roller 61 (or where a nip width is formed) can be changed evenly, and thus permanent deformation due to stress imposed in one place by the heat roller 61 can be reduced from the pressure roller 62. Accordingly, fluctuations of the nip pressure due to permanent deformation of the pressure roller 62 can be reduced.

Power of the heat roller 61 may be transmitted via the transmission gears 61G, 62G to the pressure roller 62. Comparing with a structure where power is transmitted from a drive source (not shown) disposed in the main body 2 via a plurality of gears (not shown) to the transmission gear 62G, the embodiment of the invention can reduce the number of parts.

The width W2 of the belt member 63 is greater than the width W1 of the pressure roller 62, which is greater than the width of a recording sheet P. Thus, the width of the sheet P can fit within the width W2 of the belt member 63. As the sheet P can be reliably pressed by the heat roller 61, the toner image can be fixed onto the sheet P by heat, which can offer enhanced image quality.

The belt member 63 may move in the axial direction of the rotation shaft 62A in response to rotation of the heat roller 61 and the pressure roller 62. However, as the belt member 63 is disposed around the belt supporting member 67 that has the belt regulating portions 67C and that does not move in the axial direction of the rotation shaft 62A, the movement of the belt member 63 in the axial direction can be regulated. Thus, the belt member 63 can be prevented from moving extremely to one end of the pressure roller 62 and coming off from the pressure roller 62 or shifting greatly from the pressure roller 62. As a result, the sheet P can be prevented from shifting in the axial direction. As the sheet P can be prevented from shifting in the axial direction, it can be prevented from rubbing against the heat roller 61, which can offer enhanced image quality.

The belt supporting member 67 applies tension to the belt member 63, which can keep the belt member 63 from becoming wrinkled. Thus, the heat roller 61, the sheet P, and the belt member 67 can be brought into intimate contact with each other, which can enhance transmission of heat from the heat roller 61 to the sheet P. As the transmission of heat to the sheet P is enhanced, the toner image can be efficiently fixed onto the sheet P by heat, which can offer enhanced speed of fixing. In addition, as the belt member 63 and the sheet P are brought into contact with each other, the slippage between the belt member 63 and the sheet P can be reduced more reliably. Thus, the toner image formed on the sheet P can be fixed by heat without being disturbed, so that image quality can be enhanced reliably.

As the width W2 of the belt member 63 is greater than the width W1 of the pressure roller 62, the belt supporting members 67 disposed on both ends of the roller portion 62R of the pressure roller 62 can apply tension to the belt member 63 and regulate the movement of the belt member 63 in the axial direction. In addition, as the width W3 of the heat roller 61 is greater than the width W2 of the belt member 63, the belt member 63 is pressed against the heat roller 61 across the full width of the belt member 63 in the axial direction. Thus, friction from the heat roller 61 can be transmitted to the belt member 63. As friction from the heat roller 61 is transmitted to the belt member 63, the difference in peripheral speed between the heat roller 61 and the pressure roller 62 can be absorbed. Thus, the slippage between the sheet P and the heat roller 61 can be reduced more reliably, so that image quality can be enhanced reliably.

The belt member 63 formed of a heat-resistant resin, nickel, or stainless steel, can be slidingly rotated between the heat roller 61 and the pressure roller 62 with stability because it will not soften or deform even by contact with the heat roller 61 whose surface is heated to high temperatures. As the belt member 63 is slidingly rotated between the heat roller 61 and the pressure roller 62 with stability, the toner image can be stably fixed onto the sheet P by heat, which can offer enhanced image quality reliably.

When the belt member 63 is electrically grounded, electrostatic buildup on the belt member 63 due to sliding friction between the pressure roller 62 and the belt member 63 can be prevented. As electrostatic buildup on the belt member 63 is prevented, disturbance of electrically charged toner (image) that is not fixed by heat on the sheet P can be reduced, so that image quality can be enhanced reliably.

When a surface of the belt member 63 that contacts the heat roller 61 (or sheet P during heat fixing) is coated with fluorine resin, adhesion of toner onto the belt member 63 can be reduced. Thus, adhesion of toner from the belt member 63 to the backside of the sheet P can be reduced, and dirt on the sheet P can be reduced. When a surface of the belt member 63 that contacts the pressure roller 62 is coated with fluorine resin, the pressure roller 62 and the belt member 63 can smoothly slide. Thus, the slippage between the heat roller 61 and the sheet P can be reduced, and image quality can be enhanced reliably.

This illustrative embodiment shows, but is not limited to, the structure where the transmission gears 61G, 62G are used as an example of a power transmission member. Instead, a toothed belt may be used. Alternatively, a combination of two or more different types of power transmission members, such as a transmission gear and a toothed belt, may be used.

With reference to FIG. 3, a rotational speed of the rotation shaft 62A of the pressure roller 62 per unit time when the pressure roller 62 is forced to rotate will be described.

Power of the heat roller 61 may be transmitted via the transmission gears 61G, 62G to the pressure roller 62. During heat fixing, the outside diameter of the heat roller 61 does not change, and thus it can be estimated that the peripheral speed of the heat roller 61 does not change (or is constant). Under this estimation, a rotational speed of the end 61A of the heat roller 61 and a rotational speed of the transmission gear 61G do not change, and thus the rotational speed of the transmission gear 62G of the pressure roller 62 connected to the transmission gear 61G and the rotational speed of the rotation shaft 62A do not change.

During heat fixing, the outside diameter of the pressure roller 62 changes due to thermal expansion. When the outside diameter of the pressure roller 62 changes but the rotational speed of the rotation shaft 62A does not change, the peripheral speed of the pressure roller 62 changes. Thus, a difference in peripheral speed between the heat roller 61 and the pressure roller 62 occurs, and a difference between the peripheral speed of the belt member 63 to which friction of the heat roller 61 is applied via the sheet P and the peripheral speed of the pressure roller 62 occurs. As a result, the belt member 63 and the pressure roller 62 slip.

To reduce the slippage between the belt member 63 and the pressure roller 62, the difference in peripheral speed between the heat roller 61 and the pressure roller 62 needs to be reduced. To address this, it is possible to determine the rotational speed N of the rotation shaft 62A per unit time at which, even if the outside diameter of the pressure roller 62 changes, the peripheral speed of the pressure roller 62 approximates to the peripheral speed V of the heat roller 61. In other words, the rotational speed of the shaft 62A may be adjusted to compensate for changes in peripheral speed caused by this thermal expansion.

The rotational speed N of the rotation shaft 62A may be determined in a range between the rotational speed N1 of the rotation shaft 62A at high temperature and the rotational speed N2 of the rotation shaft 62A at room temperature during heat fixing ($N1 \leqq N \leqq N2$). The rotational speed N1 of the rotation shaft 62A is a value that approximates the peripheral speed of the pressure roller 62 to the peripheral speed of the heat roller 61 when the outside diameter of the pressure roller 61 is maximum $D_{MAX}$ (when thermally expanded during heat fixing). The rotational speed N2 of the rotation shaft 62A is a value that approximates the peripheral speed of the pressure roller 62 to the peripheral speed of the heat roller 61 when the outside diameter of the pressure roller 61 is minimum $D_{MIN}$ (at room temperature during heat fixing).

Because $N1=V/\pi D_{MAX}$, and $N2=V/\pi D_{MIN}$, the rotational speed N of the rotation shaft 62A of the pressure roller 62 per unit time can satisfy the following condition:

$$V/\pi D_{MAX} \leqq N \leqq V/\pi D_{MIN}$$

where

V is peripheral speed of the heat roller 61 (conveyance speed of a recording sheet P), $D_{MAX}$ is maximum outside diameter of the pressure roller 62 during heat fixing (outside diameter of the pressure roller 62 at thermal expansion), and $D_{MIN}$ is minimum outside diameter of the pressure roller 62 during heat fixing (outside diameter of the pressure roller 62 at room temperature).

This condition can be achieved by setting a gear ratio of the transmission gears 61G, 62G to satisfy $V/\pi D_{MAX} \leqq N \leqq V/\pi D_{MIN}$.

When the rotational speed N of the rotation shaft 62A satisfies the above condition, the difference in peripheral speed between the heat roller 61 and the pressure roller 62 can be reduced. Thus, the difference between the peripheral speed of the pressure roller 62 and the peripheral speed of the belt member 63, which approximates to the peripheral speed of the heat roller 61, can be also reduced. When the difference in peripheral speed between the pressure roller 62 and the belt member 63 is reduced, the slippage between the pressure roller 62 and the belt member 63 can be reduced. This reduction can reduce a force that may hinder rotation of the belt member 63 (conveyance of a sheet P), which is generated when the pressure roller 62 and the belt member 63 slip. When the force that may hinder sheet conveyance is reduced, the slippage between the heat roller 61 and the sheet P can be reduced, and image quality can be enhanced reliably. In addition, when the slippage between the pressure roller 62 and the belt member 63 is reduced, the pressure roller 62 and the belt member 63 can be made less prone to wear.

This illustrative embodiment shows, but is not limited to, the structure where power of the heat roller 61 is transmitted via the transmission gears 61G, 62G to the pressure roller 62. Alternatively, power from a drive source, e.g. a motor, disposed in the main body 2, may be supplied to the transmission gear 62G connected to the pressure roller 62 via gears and the power of the pressure roller 62 may be transmitted via the transmission gears 61G, 62G to the heat roller 61. Alternatively, power from the drive source may be transmitted to the pressure roller 62 via driving power transmission member, e.g., a gear, but not via the heat roller 61.

Figure 5:
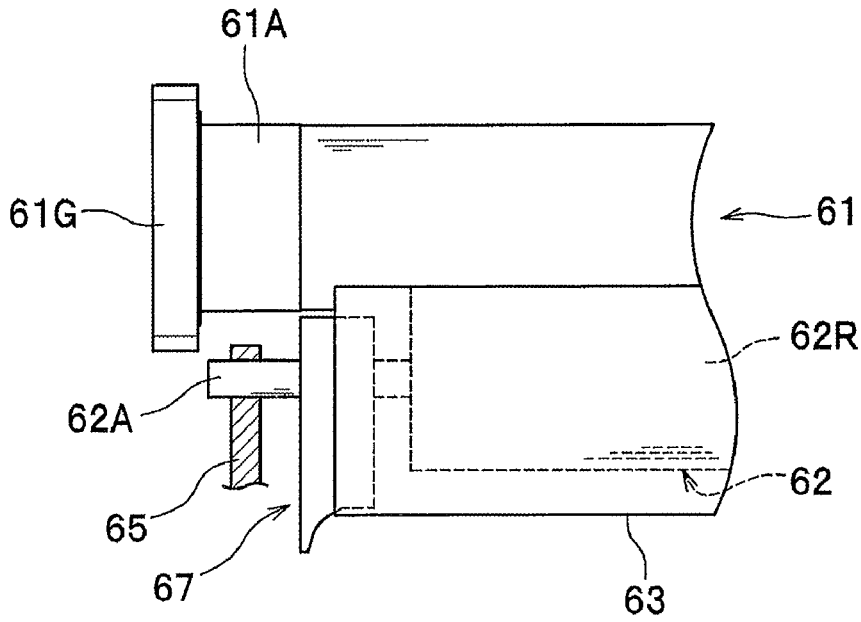
FIG. 5 schematically shows a heat roller, a pressure roller, a belt member, and a regulating member according to an alternate embodiment.

This illustrative embodiment shows, but is not limited to, the structure where power of the heat roller 61 is transmitted via the transmission gears 61G, 62G to the pressure roller 62 and the pressure roller 62 is forced to rotate. For example, as shown in FIG. 5, the transmission gear 62G may be omitted and the power of the heat roller 61 may be transmitted via the belt member 63 to the pressure roller 62, so that the pressure roller 62 may be rotated. In other words, the pressure roller 62 may be rotated upon receipt of friction between the inner surface of the belt member 63, which is slidingly rotated by the heat roller 61, and the roller portion 62R (or a sheet P during heat fixing).

When the pressure roller 62 is caused to rotate in this manner, the difference in peripheral speed between the heat roller 61 and the pressure roller 62 do not occur, and thus the difference in peripheral speed between the heat roller 61 and the belt member 63 does not occur. Because the difference in peripheral speed between the heat roller 61 and the belt member 63 does not occur, the slippage between the heat roller 61 and the sheet P can be reduced, so that image quality can be enhanced reliably. Because the difference in peripheral speed between the heat roller 61 (or the belt member 63) and the pressure roller 62 does not occur, the slippage between the pressure roller 62 and the belt member 63 can be reduced. Thus, adverse effects, such as the wearing away of the belt member 63, abrasion of fluorine resin coated on the surface of the belt member 63, and electrostatic buildup on the belt member 63 due to sliding friction between the pressure roller 62 and the belt member 63 can be reduced. Further, as the pressure roller 62 is caused to rotate, torque of the drive source (not shown) disposed in the main body 2 can be reduced.

The illustrative embodiment shows, but is not limited to, the example where the relationship among the width W1 of the pressure roller 62, the width W2 of the belt member 63, and the width W3 of the heat roller 61 is $W1<W2<W3$. The relationship may be $W1=W2=W3$, $W1<W2=W3$, or $W1=W2<W3$.

The illustrative embodiment shows, but is not limited to, the structure including the belt supporting member 67 that is configured to apply tension to the belt member 63 and regulate the axial movement of the belt member 63. The structure may include a tension-applying member that is configured to apply tension to the belt member and a regulating member that is configured to regulate the axial movement of the belt member individually. Alternatively, the structure may include one of the tension-applying member and the regulating member. The tension-applying member may be a roller that is configured to slide on the inner surface of the belt member and apply tension to the belt member between the tension-applying member and the pressure roller. The regulating member may be a disk-shaped member having the outside diameter greater than the roller portion of the pressure roller or a cylindrical-shaped member having a belt regulating portion that is rotatably attachable to the rotation shaft of the pressure roller.

The illustrative embodiment shows, but is not limited to, the structure where the belt member 63 is electrically grounded, as shown in FIG. 4A, by electrically grounding the belt supporting member 67 formed of a conductive resin and disposing the belt member 63 around the belt supporting member 67. The belt member 63 may be electrically grounded by bringing a conductive rod-shaped member that is electrically grounded in contact with the inner surface of the belt member.

The illustrative embodiment shows, but is not limited to, the structure where the pressure roller 62 is pressed against the heat roller 61 by a pressing mechanism made up of the arm members 65 and extension springs 66. A known pressing mechanism may be used for the pressure roller 62. The illustrative embodiment shows, but is not limited to, the structure where the pressure roller 61 is pressed against the heat roller 62. The heat roller may be pressed against the pressure roller.

A sheet P may include plain paper, cardboards, postcards, and transparency sheets.

The illustrative embodiment shows, but is not limited to, the structure that uses the light exposure unit 4 configured to scan laser light onto the photosensitive drum 52, the photosensitive drum 52 as a photosensitive member, the developing cartridge 55 as a developing device, and the transfer roller 54 as a transfer member. These parts may be modified in material and structure without departing from the scope of the invention.

While the features herein have been described in connection with various example structures and illustrative aspects, it will be understood by those skilled in the art that other variations and modifications of the structures and aspects described above may be made without departing from the scope of the inventions described herein. Other structures and aspects will be apparent to those skilled in the art from a consideration of the specification or practice of the features disclosed herein. It is intended that the specification and the described examples only are illustrative with the true scope of the inventions being defined by the following claims.

What is claimed is:

1. A fixing unit, comprising:

a heat roller including a heat source and being configured to rotate in response to power;

an endless belt member; and a pressure roller enclosed by the endless belt member and pressed toward the heat roller, the endless belt member being configured to slide around the pressure roller and remain in contact with the heat roller or a recording sheet, the pressure roller being rotated in response to sliding of the endless belt member, wherein the pressure roller is configured to rotate with a rotational speed per unit time that satisfies a condition expressed by $V/\pi D_{MAX} \leqq N \leqq V/\pi D_{MIN}$, where N is the rotational speed of the pressure roller per unit time, V is peripheral speed of the heat roller, $D_{MAX}$ is maximum outside diameter of the pressure roller at thermal expansion, and $D_{MIN}$ is minimum outside diameter of the pressure roller at room temperature.

2. The fixing unit according to claim 1, wherein a width of the endless belt member extending in an axial direction of the pressure roller is greater than a width of the pressure roller extending in the axial direction of the pressure roller.

3. The fixing unit according to claim 1, further comprising a supporting member configured to support the endless belt member, wherein the supporting member is attached to a shaft of the pressure roller.

4. The fixing unit according to claim 3, wherein the supporting member includes a portion configured to regulate movement of the endless belt member in the axial direction of the pressure roller.

5. The fixing unit according to claim 3, wherein the supporting member includes a portion configured to apply tension to the endless belt member.

6. The fixing unit according to claim 3, further comprising a rotation regulating member disposed in contact with the supporting member, wherein the rotation regulating member is configured to regulate rotation of the supporting member.

7. The fixing unit according to claim 6, wherein the rotation regulating member includes the heat roller.

8. The fixing unit according to claim 1, wherein a width of the endless belt member extending in an axial direction of the pressure roller is greater than a width of the pressure roller extending in the axial direction, and the width of the endless belt member is smaller than a width of the heat roller extending in an axial direction of the heat roller.

9. The fixing unit of claim 4, further comprising:

a plurality of transmission gears connecting the heat roller to the pressure roller, and configured to control the rotational speed of the pressure roller based on rotation of the heat roller.

10. A fixing unit, comprising:

a heat roller including a heat source and being configured to rotate in response to power;

an endless belt member; and a pressure roller enclosed by the endless belt member and pressed toward the heat roller, the endless belt member being configured to slide around the pressure roller and remain in contact with the heat roller or a recording sheet, the pressure roller being rotated in response to sliding of the endless belt member, wherein the pressure roller is configured to rotate upon receipt of a friction force from the endless belt member.

11. The fixing unit according to claim 10, wherein the endless belt member being partially away from the pressure roller.

12. The fixing unit according to claim 10, further comprising a power transmission member configured to transmit power of the heat roller to the pressure roller.

13. The fixing unit according to claim 10, wherein the endless belt member is electrically grounded.

14. The fixing unit according to claim 10, wherein the endless belt member is coated with fluorine resin.

15. The fixing unit according to claim 10, wherein the heat source is a halogen heater.

16. The fixing unit according to claim 10, wherein the pressure roller is disposed below the heat roller.

17. The fixing unit of claim 10, wherein a width of the endless belt member extending in an axial direction of the pressure roller is greater than a width of the pressure roller extending in the axial direction of the pressure roller.

18. The fixing unit of claim 10, further comprising a supporting member configured to support the endless belt member, wherein the supporting member is attached to a shaft of the pressure roller.

19. The fixing unit of claim 18, wherein the supporting member includes a portion configured to regulate movement of the endless belt member in the axial direction of the pressure roller.

20. The fixing unit of claim 18, wherein the supporting member includes a portion configured to apply tension to the endless belt member.

21. The fixing unit of claim 10, further comprising a rotation regulating member disposed in contact with the supporting member, wherein the rotation regulating member is configured to regulate rotation of the supporting member.

22. The fixing unit of claim 10, wherein a width of the endless belt member extending in an axial direction of the pressure roller is greater than a width of the pressure roller extending in the axial direction, and the width of the endless belt member is smaller than a width of the heat roller extending in an axial direction of the heat roller.

* * * * *